United States Patent [19]

Jenkins

[11] 3,951,353

[45] Apr. 20, 1976

[54] BOBBIN SUPPORT ASSEMBLY

[75] Inventor: Ellis H. Jenkins, Lanett, Ala.

[73] Assignee: West Point-Pepperell, Inc., West Point, Ga.

[22] Filed: May 29, 1975

[21] Appl. No.: 581,888

[52] U.S. Cl. ..... 242/129.7; 242/130

[51] Int. Cl.[2] ..... B65H 49/00

[58] Field of Search..... 242/129.5, 129.7, 129.71, 242/129.72, 130, 130.4, 136, 46.3, 46.4

[56] References Cited

UNITED STATES PATENTS

| | | | |
|---|---|---|---|
| 1,754,197 | 4/1930 | Draper | 242/130 |
| 2,582,325 | 1/1952 | Gleitz et al. | 242/46.3 |
| 2,954,183 | 9/1960 | Townsend | 242/129.7 |

*Primary Examiner*—Leonard D. Christian
*Attorney, Agent, or Firm*—Cushman, Darby & Cushman

[57] ABSTRACT

An assembly for supporting a conventional bobbin having at least one metallic ring about its base. A pair of spaced plates define a first groove for receiving the ring on one side of the bobbin. A movable plate member is provided at its bottom portion with a second groove. The latter groove is defined by a flange on the plate member and an L-shaped member secured to the plate member. The plate member is spring biased towards the spaced plates whereby the bobbin ring is received within the second groove on the opposite side of the bobbin. The retention of the ring in the grooves prevents the bobbin from being lifted from the assembly.

3 Claims, 5 Drawing Figures

BOBBIN SUPPORT ASSEMBLY

BACKGROUND OF THE INVENTION

The present invention relates to a device utilized in stripping a bobbin (sometimes called a quill) after the bobbin has passed its operative position with respect to a loom.

Presently in extensive use in textile plants is a piece of equipment called a Unifil Winder which is made by the Leesona Corporation of Warwick, Rhode Island. This equipment performs a number of operations including a bobbin stripping function now to be described.

After most of the yarn is removed from a bobbin during the weaving process, a new bobbin is placed in cooperative relationship with the loom and the previous bobbin, containing a remnant of the yarn, is transported to a bobbin support assembly which holds the bobbin while the remnant is uncoiled from the bobbin. During the uncoiling operation, the yarn is pulled in a direction which tends to lift the bobbin out of its locked position in the support assembly. In the case where a snag in the remnant occurs, or where the yarn is impeded from uncoiling in some manner, the coiler exerts a great amount of pressure via the yarn on the bobbin. With existing bobbin support assemblies this pressure is often sufficient to cause the bobbin to be released from its locked position. When this occurs the released bobbin fouls the operation of the entire Unifil Winder and necessitates that this equipment and the loom be shut down until the jam is cleared. Obviously, such a situation is troublesome and costly.

It is the principal objective of the present invention to provide an improved locking arrangement for the bobbin support device associated with a Unifil Winder, the locking arrangement being sufficient to resist forces tending to pull the bobbin out of its locked position. With such a device the jamming problem is avoided and the entire remnant of yarn can be removed from the bobbin allowing a fully stripped bobbin to be returned for rewinding.

SUMMARY OF THE INVENTION

Briefly the invention comprises a bobbin support assembly having a locking arrangement which cooperates with a conventional metallic ring wound about the base of the bobbin. The locking arrangement cooperates with the ring at opposite sides of the bobbin at the ring's upper and lower surfaces. Consequently during stripping the force of the coiled yarn remnant tending to lift the bobbin from the support device is resisted, and the bobbin is not able to assume a position which would permit the bobbin to be released from its locked condition.

The invention is more clearly set forth in the following detailed description of the invention and in the accompanying drawings wherein.

DETAILED DESCRIPTION OF THE INVENTION

Figure 1:
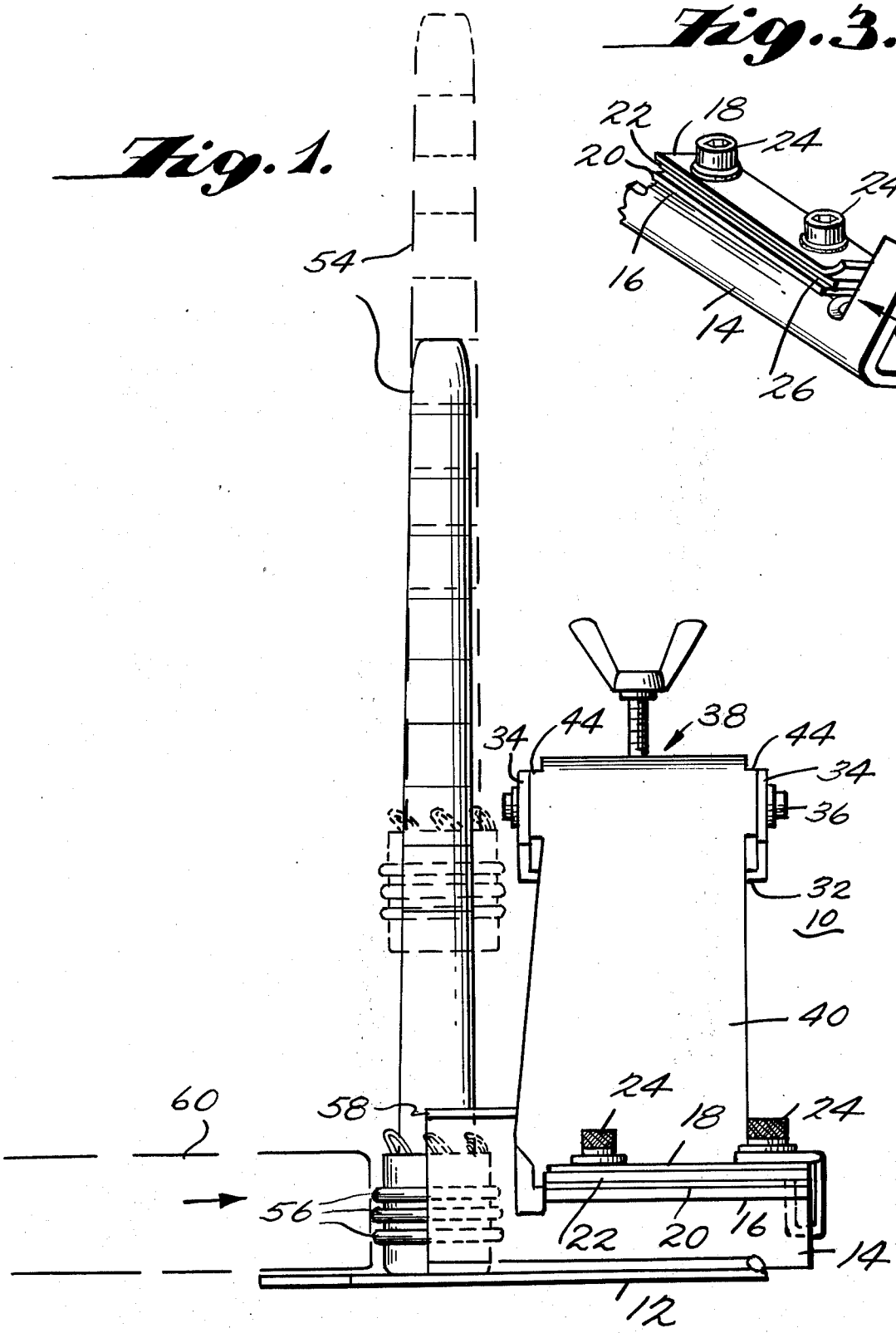
FIG. 1 is a side elevational view of a conventional bobbin support assembly, a bobbin being diagramatically illustrated as it moves into position with respect to said assembly.
Figure 3:
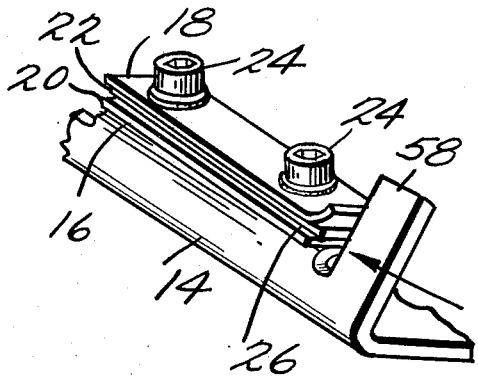
FIG. 3 is a perspective view of a portion of the structure shown in FIGS. 1 and 2.
Figure 2:
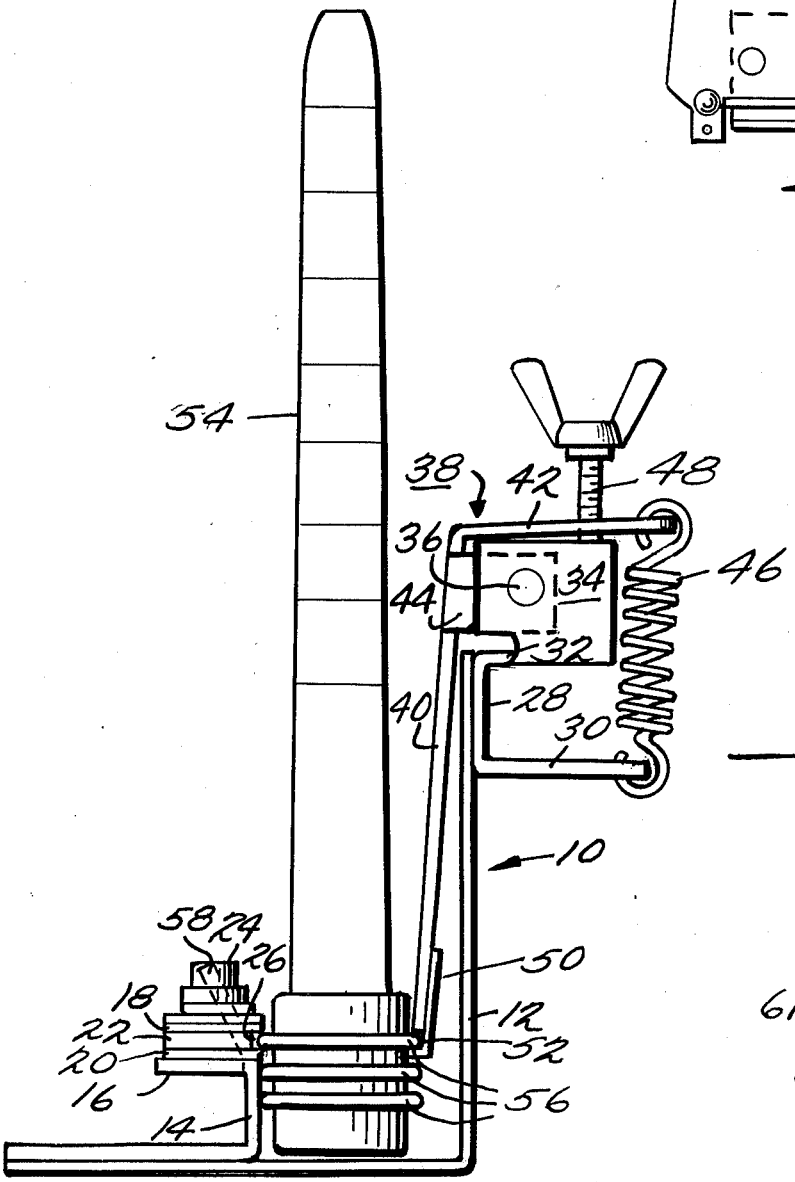
FIG. 2 is an elevational view taken from an end of the assembly shown in FIG. 1, the bobbin being illustrated in its locked position.

Referring to FIGS. 1–3, a conventional bobbin support assembly is shown and is generally indicated by the numeral 10. The assembly comprises a main frame member 12 which is generally L-shaped as shown in FIG. 2. A mounting bracket 14 is secured to frame 12. Bracket 14 is formed to provide a horizontally extending surface 16 which serves as a base to support a pair of plates 18 and 20 separated by a spacer 22. The plates 18 and 20 and spacer 22 are secured to base 16 by conventional means such as threaded devices 24. The edges of plates 18 and 20 project beyond the edge of spacer 22 to form a horizontally oriented groove, or channel, between the plates 26. This groove serves to lock one side of the bobbin as will be described hereinafter.

Also secured to an upstanding portion of the frame 12 is a spring-loaded mechanism which serves to lock the opposite side of the bobbin. This mechanism includes a bracket 28 (FIG. 2) having horizontally extending portions 30 and 32. Dependent flanges 34 extend vertically from opposite ends of portion 32. These flanges serve to support the ends of rod 36. A bent plate 38 is provided which comprises a vertically extending portion 40 and a horizontal portion 42. Portion 40 at its upper end includes a pair of dependent ears 44 on opposite sides thereof. Rod 36 projects through these ears whereby plate 38 is pivotally mounted on the rod. A spring 46 extends between the ends of portions 42 and 30 so as to bias the plate 38 in a clockwise direction as viewed in FIG. 2. A threaded wing-nut 48 projects through portion 42 towards portion 32. This wing-nut is adjustable to control the amount of clockwise movement of plate 38, the limit being reached when the end of wing-nut 48 contacts portion 42 to prevent further rotation.

Means for engaging the bobbin are provided at the lower edge of portion 40 of the plate 38. These include an L-shaped member 50 the bottom of which is secured to plate portion 40 in a manner such that the bottom of member 50 projects below portion 40. As a result, the bottom edge of portion 40 and the projecting L-portion of member 50 define a groove or channel 52 having a depth which corresponds to the thickness of portion 40.

Now that the structure of the conventional support device has been described, its operation and deficiencies will be outlined.

Referring to FIG. 1 a bobbin 54 is illustrated as it drops from a position shown in dash lines into engagement with the frame 12, as shown in full lines. This bobbin is of the conventional type having a plurality of spaced metallic rings 56 surrounding its base. For convenience of illustration, the remnant of yarn left on the bobbin after the weaving operation has been omitted. However, it will be understood that the end of this remnant is connected to a coiler (not shown) which is positioned above the top of the bobbin. With the bobbin having dropped to the full line position shown in FIG. 1 (it having been guided thereto by a projecting ear 58 extending from bracket 14 — see FIG. 3), a plunger diagramatically illustrated as 60 in FIG. 1 moves the bobbin in the direction of the arrow heads shown in FIGS. 1 and 3 into cooperative relationship with the locking arrangement. More particularly, the uppermost metallic ring 56 at the base of the bobbin 54 is moved into grooves or channels 26 and 52. These grooves support the bobbin at opposite sides thereof and are intended to prevent the bobbin from lifting. However, when the normal force exerted on the bobbin by the uncoiling operation is exceeded due to a jam or snag of the remnant as it is being pulled vertically from the bobbin, the bobbin 54 is able to tilt in the direction of plate portion 40 thereby releasing the upper surface of the top ring 56 from groove 26. Continued pulling of the bobbin in a direction along its principal axis urges the spring loaded plate 38 in a counterclockwise direction with respect to the view shown in FIG. 2 thereby causing the upper surface of the top ring 56 to also be released from groove 52. As a result, the bobbin disengages from the support device and thus jams the coiling equipmnt. This causes the entire bobbin stripping operation to be interrupted, and the loom must be shut down until the mechanism is cleared and again readied for operation.

Figure 4:
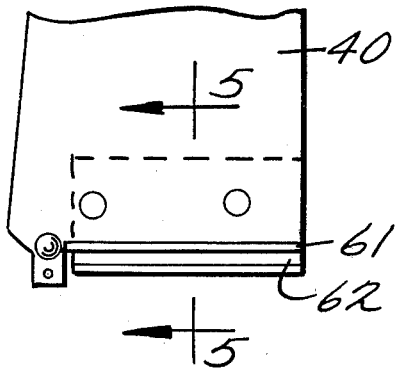
FIG. 4 is a fragmented view of a portion of a bobbin support assembly which incorporates the present invention.
Figure 5:
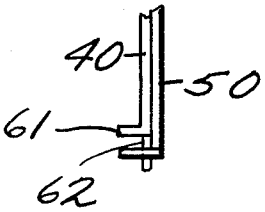
FIG. 5 is a sectional view taken along lines 5—5 of FIG. 4.

To overcome the malfunction just described, the present invention has been devised. This is illustrated in FIGS. 4 and 5. More particularly, the bottom edge of plate portion 40 is provided with a horizontally extending flange portion 61, and the horizontally extending portion of the L-shaped member 50 is projected to a distance corresponding to that of portion 61. As a result, a groove or channel 62 is formed which in depth is considerably in excess of the thickness of plate 40. The ends of the flange 61 and its counterpart at the bottom of plate 50 act on the side of the bobbin to urge the upper bobbin ring 56 into the groove 26 on the opposite side of the bobbin. Thus, the tendency of the bobbin to twist causing ring 56 to move from the groove 26 is greatly reduced and even if the ring is displaced from groove 56, the flange 61 prevents the bobbin from lifting out of groove 62. Consequently, the bobbin cannot move upwardly from the support device so as to jam the entire machine.

Once the remnant is completely removed from a bobbin, another bobbin is dropped to the full line position shown in FIG. 1. The plunger 60 forces the latter bobbin into the supporting device and this operation causes the stripped bobbin to be moved laterally out of the locked position thereby freeing it to be returned to a position where a supply of yarn may be wound on it.

What is claimed is

1. An assembly for supporting a bobbin having at least one metallic ring about its base, said assembly comprising:

a frame member;

means on said frame member for supporting in fixed position a pair of plates separated by a spacer to define a first groove between said plates and the edge of said spacer, said groove being dimensioned to receive said ring;

a movable plate member having a vertically extending portion, said plate member being pivotally connected to said frame and spring biased to urge the vertically extending portion of the plate member towards said fixed plates; and means positioned at the bottom of said vertically extending portion defining a second groove dimensioned to receive said bobbin ring, said means defining the second groove including:

a flange positioned at the bottom edge of said vertically extending portion and projecting towards the fixed plates; and an L-shaped member secured to said vertically extending portion of the plate member and having a horizontally extending portion spaced from the flange.

2. An assembly as set forth in claim 1, wherein said flange is positioned above the horizontally extending portion of the L-shaped member.

3. An assembly as set forth in claim 1, wherein said flange and the horizontally extending portion of the L-shaped member project towards the fixed plates for a distance in excess of the thickness of the vertically extending portion of the plate member.

* * * * *